US005979427A

United States Patent [19]

Chalin et al.

[11] Patent Number: 5,979,427

[45] Date of Patent: Nov. 9, 1999

[54] PEEP SIGHT APPARATUS

[76] Inventors: Philip J. Chalin, 390 E. 11 Mile Rd., Sault Ste. Marie, Mich. 49783; Manuel Chalin, 64 Evergreen Dr., Kincheloe, Mich. 49788

[21] Appl. No.: 09/018,848

[22] Filed: Feb. 6, 1998

Related U.S. Application Data

[60] Provisional application No. 60/037,399, Feb. 6, 1997.

[51] Int. Cl.[6] ..... F41G 1/467

[52] U.S. Cl. ..... 124/87; 124/90; 33/265

[58] Field of Search ..... 124/87, 90; 33/265

[56] References Cited

U.S. PATENT DOCUMENTS

| | | | |
|---|---|---|---|
| D. 344,123 | 2/1994 | Bertram | D22/107 |
| 4,552,121 | 11/1985 | Treaster | 124/87 |
| 4,625,422 | 12/1986 | Carlson | 33/265 |
| 4,656,746 | 4/1987 | Gillespie | 33/265 |
| 4,895,129 | 1/1990 | Hedgpeth | 124/87 |
| 4,965,938 | 10/1990 | Saunders | 33/265 |
| 5,347,976 | 9/1994 | Saunders | 124/87 |
| 5,379,747 | 1/1995 | Morris et al. | 124/87 |
| 5,379,748 | 1/1995 | Carlson | 124/87 |
| 5,542,186 | 8/1996 | Saunders | 33/265 |

*Primary Examiner*—John A. Ricci
*Attorney, Agent, or Firm*—Lowe Hauptman Gopstein Gilman & Berner

[57] ABSTRACT

A peep sight apparatus includes a spring portion for surrounding a portion of a bow string and has a first end and a second end. A loop portion extends from the first end of the spring portion. A counterweight portion is fixedly connected to the second end of the spring portion.

18 Claims, 3 Drawing Sheets

PEEP SIGHT APPARATUS

RELATED APPLICATIONS

The present application claims priority from provisional patent application Ser. No. 60/037,399, filed Feb. 6, 1997, entitled "Peep Sight Apparatus", which is incorporated herein by reference.

TECHNICAL FIELD

The present invention relates generally to peep sight apparatus and, more particularly, peep sight apparatus for use in conjunction with an archery bow having a bow string.

BACKGROUND ART

The use of bow string-mounted peep sights is known in the archery art. Many different types of peep sight structures have been employed in the art, but none has proven completely satisfactory. In some instances, the attachment of the peep sight to the bow string has been complex and inconvenient. Other arrangements have resulted in physical imbalance in the bow string. Still other arrangements result in peep sights which are not securely retained and are subject to undesirable physical shifting along the bow string.

U.S. Design Pat. No. D344,123 discloses an arrangement which overcomes many of the above identified problems. This arrangement has several disadvantages. Because the counterweight is slidable, the counterweight sometimes may bind on the string and the peep sight does not always return to the same spot on the string. Also, because the peep sight loop forms a complete circle, a rubber grommet must be pushed into the closed loop which is difficult and awkward to accomplish.

SUMMARY OF THE INVENTION

It is, therefore, an object of the present invention to provide a peep sight apparatus which solves the abovementioned problems.

It is another object of the invention to provide a peep sight apparatus having a counterweight fixedly connected to a spring which surrounds a portion of the bow string.

It is another object of the present invention to provide a loop portion of the peep sight apparatus which extends for less than 360° and is flexible.

It is another object of the present invention to provide a peep sight apparatus which is simple in construction, effective in use, and economical to manufacture.

These and other objects of the present invention are achieved by providing a peep sight apparatus for use in conjunction with an archery bow having a bow string. The peep sight apparatus comprises a spring portion for surrounding a portion of a bow string and has a first end and a second end. A loop portion extends from the first end of the spring portion. A counterweight portion is fixedly connected to the second end of the spring portion.

These and other objects are also achieved by providing a flexible loop portion so as to allow an eyesight to be snap-fit thereto.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modification in various obvious respects, all without departing from the invention. Accordingly, the drawing and description are not to be regarded as illustrative in nature, and not as restrictive.

BRIEF DESCRIPTION OF DRAWINGS

For a more complete understanding of the present invention and advantages thereof, reference is now made to the following description taken in conjunction with the accompanying drawings in which like reference numbers indicate like features and wherein.

BEST MODE FOR CARRYING OUT THE INVENTION

Figure 1:
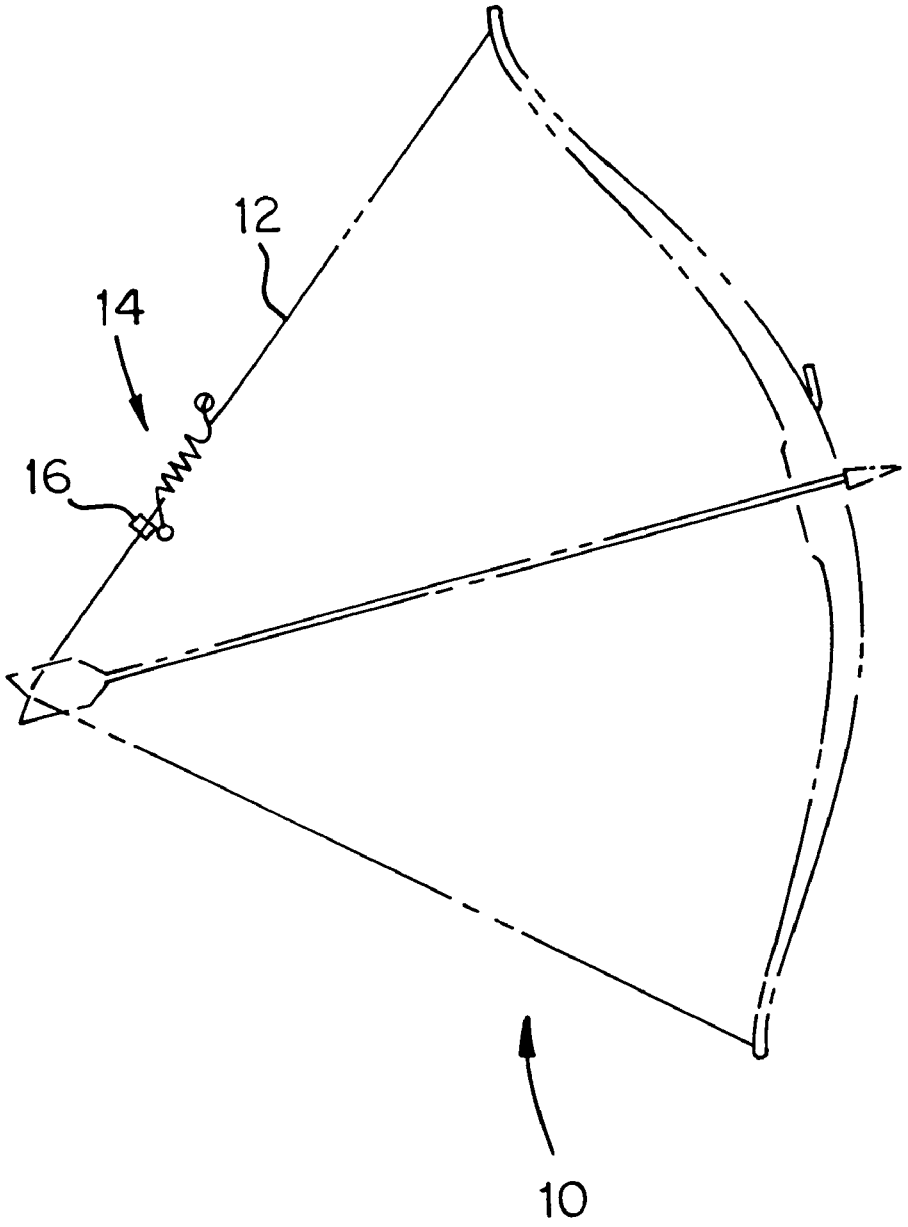
FIG. 1 is a side view of the preferred embodiment of the peep sight apparatus of the present invention illustrating the placement of the sight on an archery bow and the positioning of the sight when the bow string is pulled in firing position.
Figure 3:
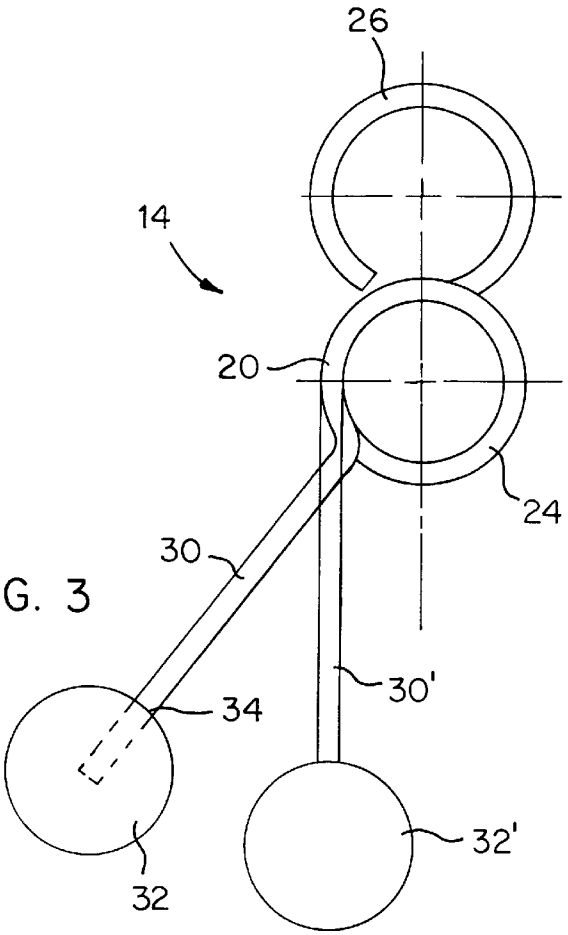
FIG. 3 is an end view of the peep sight apparatus of FIGS. 1 and 2.
Figure 2:
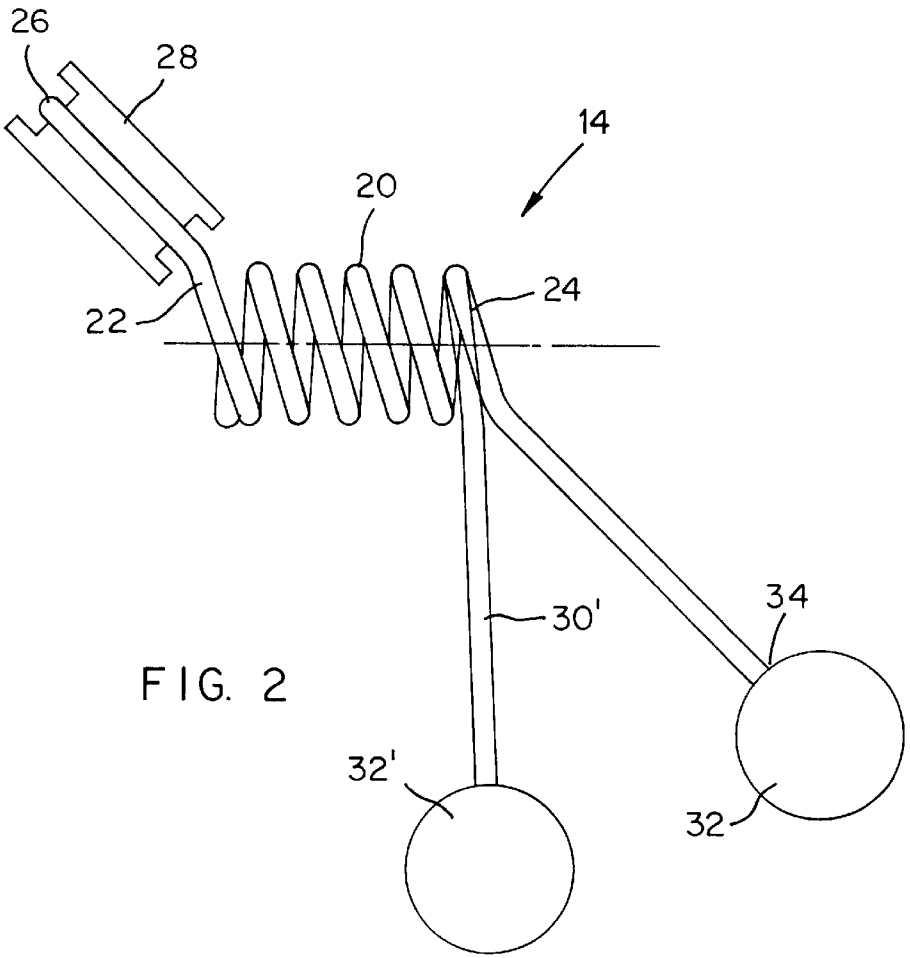
FIG. 2 is a side view of the peep sight apparatus of FIG. 1.

Referring first to FIGS. 1, 2 and 3, there is depicted a peep sight apparatus which is constructed in accordance with the principles of the present invention. As depicted in FIG. 1, reference numeral 10 generally designates a bow which is equipped with a bow string 12. In accordance with the present invention, mounted on the bow string 12 is a peep sight assembly 14. A conventional common nock 16 is secured to bowstring 12 and prevents peep sight assembly from moving downwardly.

Peep sight assembly 14 comprises a helical spring portion 20 which surrounds and is mounted to bow string 12 as depicted in FIG. 1. As depicted in FIG. 2, spring portion 20 has a first end 22 and a second end 24. Extending from first end 22 is a loop portion which as depicted in FIG. 3 extends for less than 360° but preferably more than 270°. Because loop portion 26 is not a closed circle, loop portion 26 has flexibility. Mounted within loop portion 26 is an eye piece 28 which is snap-fit into loop portion 26. Eye piece 28 is preferably made from a hard plastic material.

Extending from second end 24 is a straight portion 30 which has a counterweight ball 32 fixedly mounted to a distal end 34 by a method such as silver soldering. Ball 32 is preferably made of brass, although it can be made of other materials such as steel. The peep sight apparatus 14 according to the present invention can be TEFLON® coated with a material such as XYLAN 1010. Because counterweight ball 32 is fixedly attached to spring portion 20, advantageously no noise is generated by the apparatus 14 as in prior art devices. Also advantageously, because no friction is generated by moving parts, the peep sight advantageously remains at the same spot and will not bind on the string when the bow is moved to the firing position.

FIGS. 2 and 3 also illustrate a second embodiment of the invention wherein straight portion 30 instead extends vertically down from second end 24 as a straight portion 30' carrying ball 32' which is identical to ball 32. This vertical positioning is also shown in the end elevation view of FIG. 3.

Preferably, the material forming helical spring portion 20 as well as loop portion 26 and straight portion 30 is a music spring quality wire, such as a steel wire having a diameter of 0.050–0.070 inch and particularly 0.0625 inch. It has been discovered that this type of wire results in an extremely durable peep sight which is capable of firing 3000 to 5,000 shots (depending on poundage of the bow) without unwinding.

Figure 4:
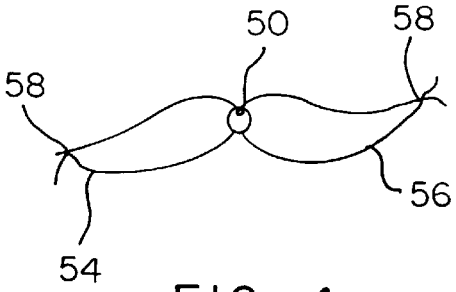
FIG. 4 is a perspective view of a method and structure for attaching the bead to the bow string.
Figure 5:
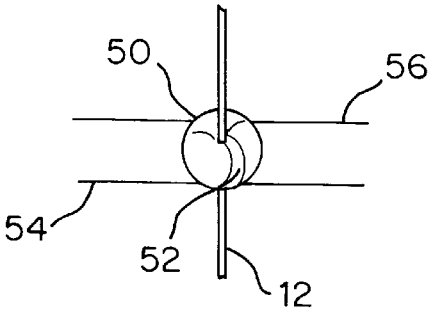
FIG. 5 is a sequential view of the bead spread apart by the strings for attachment to the bow string.
Figure 7:
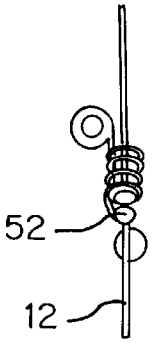
FIG. 7 is a view of the peep spring completely attached and mounted onto the bow string.
Figure 6:
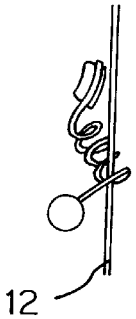
FIG. 6 is a sequential view of the peep spring being initially wound onto the bow string.

In the preferred embodiment, a nock 50 in the form of a closed plastic bead formed with a slit 52 is snugly fitted to the bow string 12 to locate the peep sight 14 in proper position (FIG. 1). To use peep sight 14, the bow is preferably first placed in a bow press. With the bow string 12 relaxed, the spring 20 with the peep toward the top of the bow is wrapped around the bow string as depicted in FIGS. 6 and 7. The bow may then be removed from the press. One of two strings 54 and 56 (see FIGS. 4 and 5) is then threaded through the bead 50 and a knot 58 is tied leaving a loop of preferably about 3 to 4 inches in diameter. The process is repeated with the second string 56. The plastic bead 50 has a slit 52 on one side thereof. The purpose of the string loops 54,56 is to pull the bead open so it will fit onto the bow string 12 proximate the location of the peep 14. This will allow the peep 14 to swivel freely on the bow string 12.

Once the slit 52 is located on the bead in spread apart position, the bead is held with the knotted loops under the bow string. The object is to take one loop in each hand and pull the bead open enough to go over the bow string 12. The bead is then pulled onto the bow string as depicted in FIG. 5. The strings may then be cut away and discarded.

Figure 8:
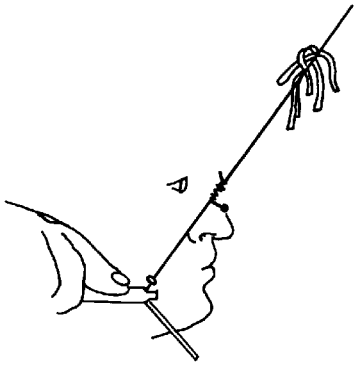
FIG. 8 is a perspective view of the peep spring in use.

The peep spring is then moved to the sighting area. The bead 50 is slid up to the spring. Once adjustments are made, the bow is ready to use as depicted in FIG. 8.

Preferably, the bead 50, strings 54,56, peep sight assembly 14 and optionally one or more nocks, may be packaged with installation instructions and sold as a packaged unit.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is, therefore, intended that the protection granted hereon be limited only by the definition contained in the appending claims and equivalents thereof.

What is claimed is:

1. A peep sight apparatus for use in conjunction with an archery bow having a bowstring, comprising:

a spring portion for surrounding a portion of the bowstring and having a first end and a second end;

a loop portion extending from said first end of said spring portion;

a counterweight portion fixedly connected to said second end of said spring portion.

2. The peep sight apparatus of claim 1, wherein said spring portion is a helical spring.

3. The peep sight apparatus of claim 1, wherein said loop portion extends for less than 360°.

4. The peep sight apparatus of claim 1, wherein said second end of said spring portion includes a straight portion extending away from said spring portion, said straight portion connected on one end to said spring portion and on an opposite end to said counterweight portion.

5. The peep sight apparatus of claim 1, wherein said peep sight is formed of metal.

6. The peep sight apparatus of claim 1, wherein said loop portion is formed from a wire having a circular cross section.

7. The peep sight apparatus of claim 1, wherein said counterweight is a ball.

8. The peep sight apparatus of claim 1, wherein said spring portion is shaped like a helical spring.

9. The peep sight apparatus of claim 1, further comprising an eyesight received by said loop portion.

10. The peep sight apparatus of claim 9, wherein said eyesight is formed of a hard plastic.

11. The peep sight apparatus of claim 1, wherein said loop portion is flexible so as to allow an eyesight to be snap-fit thereto.

12. The peep sight apparatus of claim 1, wherein a common nock is secured to the bowstring and located therebelow for preventing the downward movement of said peep sight assembly.

13. The peep sight apparatus of claim 1, wherein said spring portion and loop portion are made of a steel wire.

14. The peep site apparatus of claim 13, wherein said steel wire is music spring steel wire.

15. The peep sight apparatus of claim 14, wherein said wire has a diameter of 0.0625 inch.

16. The peep sight apparatus of claim 13, wherein said steel wire has a diameter of 0.050 inch –0.070 inch.

17. The peep sight apparatus of claim 1, further comprising a bead formed with a slit, and a pair of strings, all sold as a packaged unit within packaging material.

18. Peep sight apparatus for use in conjunction with an archery bow having a bow string, comprising:

a spring portion for surrounding a portion of the bow string;

a loop portion extending from a portion of the spring portion; and a counterweight portion fixedly connected to another portion of said spring portion.

* * * * *